US006766626B2

(12) United States Patent
Rebres et al.

(10) Patent No.: US 6,766,626 B2
(45) Date of Patent: Jul. 27, 2004

(54) FLOATING STRIPPING SKIS FOR MAILING MACHINE

(75) Inventors: Robert P. Rebres, Southbury, CT (US); Steven A. Supron, Middlebury, CT (US); Eric A. Belec, Southbury, CT (US); Christopher Uschmann, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 2 days.

(21) Appl. No.: 10/271,124

(22) Filed: Oct. 15, 2002

(65) Prior Publication Data

US 2004/0068959 A1 Apr. 15, 2004

(51) Int. Cl.[7] ..... B65B 43/26
(52) U.S. Cl. ..... 53/381.7; 53/381.5; 53/460
(58) Field of Search ..... 53/460, 468, 492, 53/381.5, 381.6, 381.7; 156/441.5, 442.1, 442.2, 442.4

(56) References Cited

U.S. PATENT DOCUMENTS 2,028,277 A * 1/1936 Finfrock ..... 156/442.1
3,474,711 A * 10/1969 Swinyar ..... 53/381.7
3,878,025 A * 4/1975 Storace et al. ..... 156/441.5
4,450,037 A 5/1984 Gavronsky
4,551,188 A * 11/1985 Schulze ..... 53/381.7
4,864,802 A * 9/1989 D'Angelo ..... 53/450
4,955,483 A 9/1990 O'Dea et al.
4,971,686 A 11/1990 O'Dea et al.
5,138,816 A * 8/1992 Holbrook et al. ..... 53/381.7
5,178,715 A * 1/1993 Rehberg ..... 53/381.7
5,217,551 A * 6/1993 Nobile et al. ..... 156/442.1
5,385,627 A 1/1995 Weimer
5,665,198 A * 9/1997 Bieber et al. ..... 156/442.1
6,530,192 B2 * 3/2003 Buckley et al. ..... 53/381.7

* cited by examiner

*Primary Examiner*—John Sipos
*Assistant Examiner*—Louis Huynh
(74) *Attorney, Agent, or Firm*—Brian A. Lemm; Angelo N. Chaclas

(57) ABSTRACT

The present invention includes apparatus and methods for guiding a mail piece traversing a mailing machine. A multi-ski guide can include an inner ski with one or more contact bumps positioned to engage a mail piece prior to its edge encountering a stripper blade. The multi-ski guide can be attached to a take away idler shaft located just prior to the stripping blade. A spring can provide a normal force holding the multi-ski guide down onto the top of the stripping blade. The multi-ski guide can contact the stripping blade with a contact bump. In addition, one or more inner skis can include mail piece guiding contact bumps. Idler segments can be interspersed between the skis included in the multi-ski guide such that the idler segments can guide and straighten a mail piece approaching the stripper blade.

24 Claims, 4 Drawing Sheets

FLOATING STRIPPING SKIS FOR MAILING MACHINE

BACKGROUND

This invention relates generally to the field of mailing machines, and more particularly to guiding and feeding a mailpiece into and out of operational engagement with an envelope flap moistening apparatus on a mailing machine.

Generally, a mail piece feeder on a mailing machine transports envelopes and other mailpieces along a deck so that various functions may be performed on the mailpiece at different locations along the deck. For example, one location along a deck may weigh the mailpiece, another location may seal the mailpiece and still another location may apply an indicia for postage to the mailpiece. Typically, drive rollers are mounted along the deck with a radial portion contacting each envelope to propel the envelope along the deck. The drive rollers can extend, for example, through aligned cutouts in the deck. The drive rollers move the mailpiece along the deck to different locations on the deck where a function may be performed.

A sealing function performed by a mailing machine can include a structure for deflecting a flap of a moving envelope away from the envelope's body to enable a moisture deposition process to occur. The structure can include a stripper blade that becomes inserted between the flap of the envelope and the body of the envelope as the envelope traverses the deck. The moisture deposition moistens an adhesive that is present on the inner surface of the envelope flap before the envelope is fed into a nip which serves to seal the envelope with the moistened adhesive.

Envelopes are increasingly available in a variety of sizes and thickness, which makes it difficult to design into a mailing machine optimum interaction between an envelope and the stripper blade. For example, a commercial business envelope may have dimensions of 4⅛ inches by 9½ inches, a baronial envelope may have dimensions of 4¾ inches by 6½ inches, an announcement envelope may have dimensions of 4⅜ by 5¾ inches or 6 by 9½ inches, a square envelope may have dimensions of 5 inches by 5 inches, 6 inches by 6 inches, or 8 inches by 8 inches. Multiple other sizes and dimensions of envelopes are also common. In addition, various envelopes can include different shape flaps, such as tapered or square, and different thickness, such as an envelope containing one sheet of paper as compared to an envelope with several card stock inserts. Optimum interaction between a stripper blade and an envelope can depend upon envelope size, shape and thickness. With various multiple sizes and shapes of envelopes and flaps, it is difficult to predetermine placement of a guide to facilitate optimum interaction, relative to an envelope path and a stripper blade.

Therefore, it would be advantageous to provide methods and apparatus that overcame the drawbacks of the prior art. In particular, it would be desirable to provide a method and apparatus to efficiently guide envelopes of various sizes and shapes into a stripper blade.

SUMMARY

Accordingly, an improved method and apparatus for guiding a mailpiece traversing a deck of a mailing machine is provided. The improved apparatus includes a mechanism for feeding a mailpiece in a path along a transport deck having a stripper blade horizontally aligned with the transport deck for operational engagement with the mail piece traversing the transport deck. A feeder portion can provide a mail piece across a transport deck and into engagement with a stripper blade which separates an envelope flap from an envelope body. The stripper blade can have a blade edge for engaging the mail piece. Typical embodiments can include a blade edge profile with an arc and skis of staggered lengths generally conforming to the shape of an arc.

A multi-ski guide is located prior to the stripping blade. For example, a multi-ski guide can include 3 skis. The relative length of each ski included in the multi-ski guide will correlate generally with a blade edge profile of the stripper blade. One or more springs can provide a normal force to hold the multi-ski guide against the stripper blade, such as, for example, a separate spring for each ski. Embodiments can include a normal force provided by the spring in the range of 0.3 pounds to 0.6 pounds of pressure on each ski comprising the multi-ski guide. Different skis can have different normal forces applied.

In another aspect, each ski included in the multi-ski guide can include at least one contact bump formed onto the lower side of the ski for contacting the stripper blade. In addition, embodiments can include an inner most ski on the multi-ski guide with one or more mail piece guiding bumps formed on the lower side. The guiding bumps can be positioned to make first contact with the mailpiece traversing the transport deck prior to the mailpiece engaging the stripper blade and remain in contact with the mailpiece until it passes beyond the ski.

Embodiments can include the contact bumps resting on top of the stripper blade at any useful distance from the edge of the blade, such as within approximately 2 mm to 3 mm from the leading edge of the stripper blade, or 3 mm or more from the edge of the stripper blade.

Still another aspect can include one or more idler segments for guiding the mail piece into engagement with the stripper blade. For example, embodiments can include four idler segments such that the idler segments extend the width of the stripper blade and two idler segments are interspersed between skis comprising the multi-ski guide.

The lower surface of the skis included in the multi-ski guide form a floating paper guide for facilitating mail pieces engaging the stripper blade after the mail piece edge has passed the stripper blade edge and before a mail piece flap edge reaches the leading edge of the stripper blade. An inner ski included in the floating paper guide can further include an extended portion supporting at least one mail piece guiding bump. Typically, the extended portion will extend inward and forward towards the stripping blade.

In still another aspect, a method is disclosed for guiding a mailpiece along a path of a transport deck on a mailing machine into operational engagement with a stripper blade by feeding a mail piece across a transport deck and into engagement with a stripper blade for separating an envelope flap from an envelope body. The stripper blade can have a blade edge for engaging the envelope flap.

The mail piece is guided with a multi-ski guide located prior to the stripping blade, wherein the relative length of each ski included in the multi-ski guide correlates generally with a blade edge profile of the stripper blade. A normal force is applied, such as with a spring, to hold each of the multi-ski guide against the stripper blade.

The method can include contacting the stripper blade with at least one contact bump formed into each ski comprising the multi-ski guide. The multi-ski guide can be attached to a take away idler shaft located prior to the stripping blade and idler segments can be positioned between each ski.

Therefore, it should now be apparent that the invention substantially achieves all the above aspects and advantages. Additional aspects and advantages of the invention will be set forth In the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes apparatus and methods for guiding a mail piece traversing a mailing machine. A guide can include multiple skis with one or more contact bumps positioned to engage a mail piece prior to its edge encountering a stripper blade.

Figure 1:
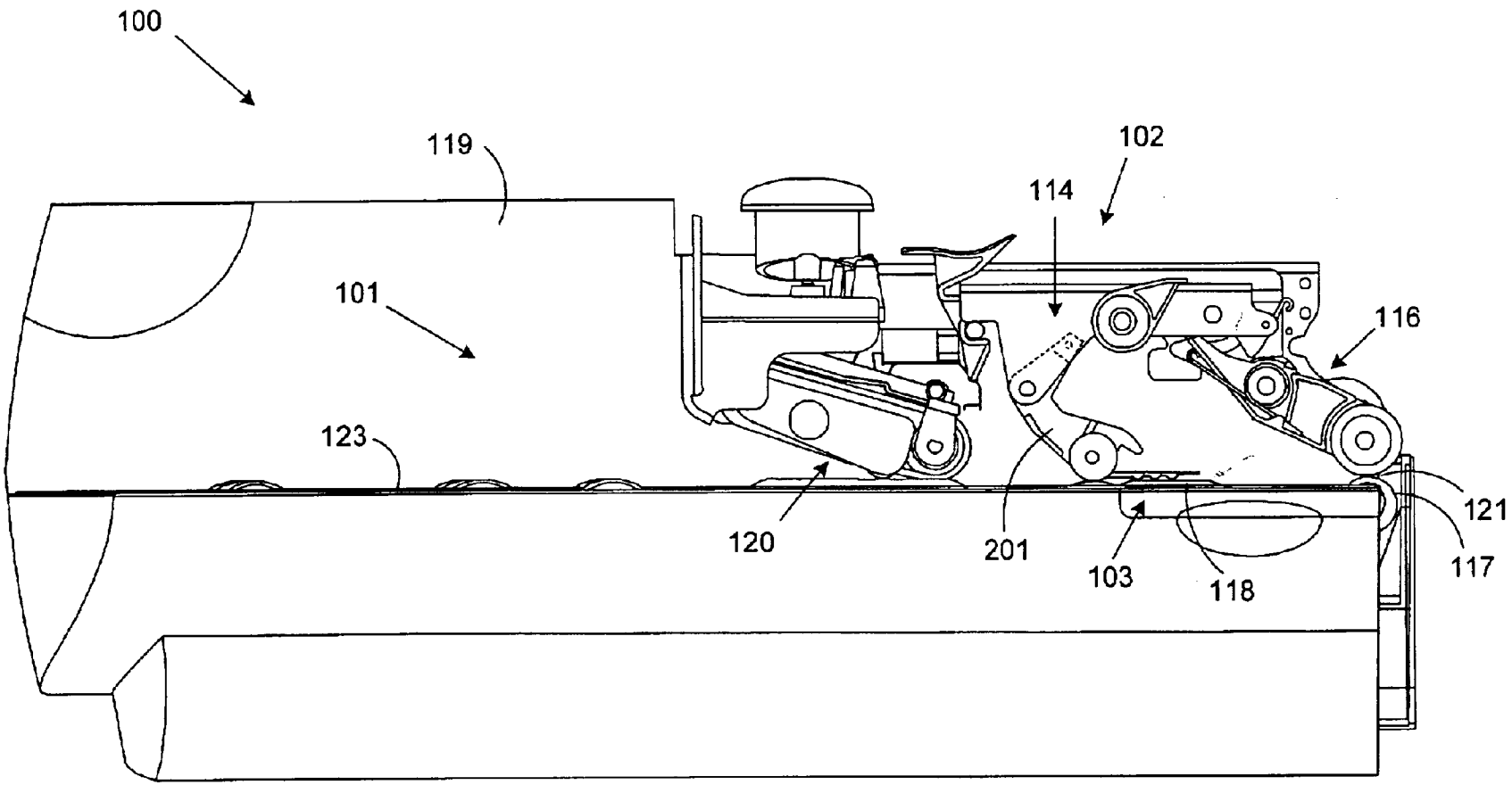
FIG. 1 illustrates basics components that can be included in a mailing machine according to the present invention.

Referring now to FIG. 1, basics components included in a mailing machine 100 according to the present invention are illustrated. Generally, a mailing machine 100 can include a feeder portion 101, an upper transport portion 102 and a mail piece flap separator and moistener portion 103. Mail pieces, such as a stack of envelopes, can be stacked against a registration wall 119 in the feeder portion 101 and fed into a singulator 120. The envelopes, or other mail pieces, can be fed, for example, with one or more belt drives and rollers. The singulator 120 can transform a bulk flow of envelopes into a single stream of individual envelopes.

Each envelope can pass through the singulator 120 and into a mail flap separator and moistener portion 103, which can include a stripper blade 118. The stripper blade 118 can be utilized to separate a flap portion of an envelope away from a body portion of the envelope and allow the flap to be moistened by a moistener (not shown). Preferably, the blade edge 115 (FIG. 3) of the stripper blade 118 is curved to form the shape of an arc.

A first upper transport 114 and a second upper transport 116 can be utilized to provide traversing motion to each envelope and move it along a transport deck 123 and through the separator and moistener portion 103 into a nip 121. Movement of an envelope can be performed by rotational movement of drive/idler roller pairs positioned along the transport deck 123. For example, each upper transport 114, 116 can include one or more idler rollers which are rotatively mounted into each respective upper transport 114, 116 opposing the drive rollers. The idler rollers can be positioned such that while each upper transport 114, 116 is in a home position, the rollers will contact a mail piece and facilitate the mail piece traversing the transport deck 123. Of course, the upper transports 114, 116 can include one or more drive rollers which oppose idler rollers positioned along the transport deck. The nip 121 can be formed by a lower roller 117 positioned below the second upper transport 116 following moistening of the envelope flap. According to the present invention, upper transport 114 includes a multi-ski assembly 201 to guide a transported envelope into the stripper blade 118.

Figure 2:
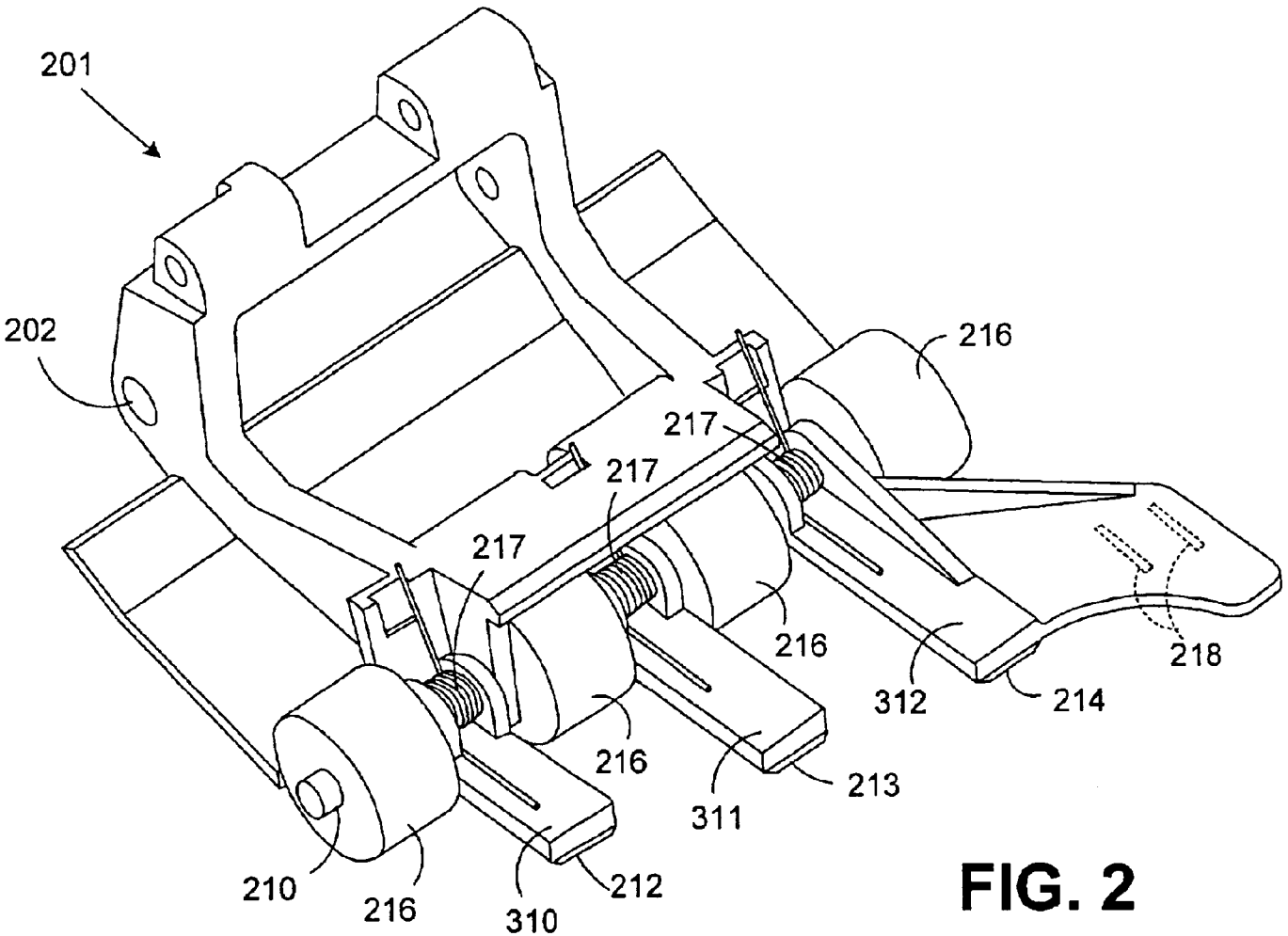
FIG. 2 illustrates a profile of an exemplary multi-ski assembly.
Figure 3:
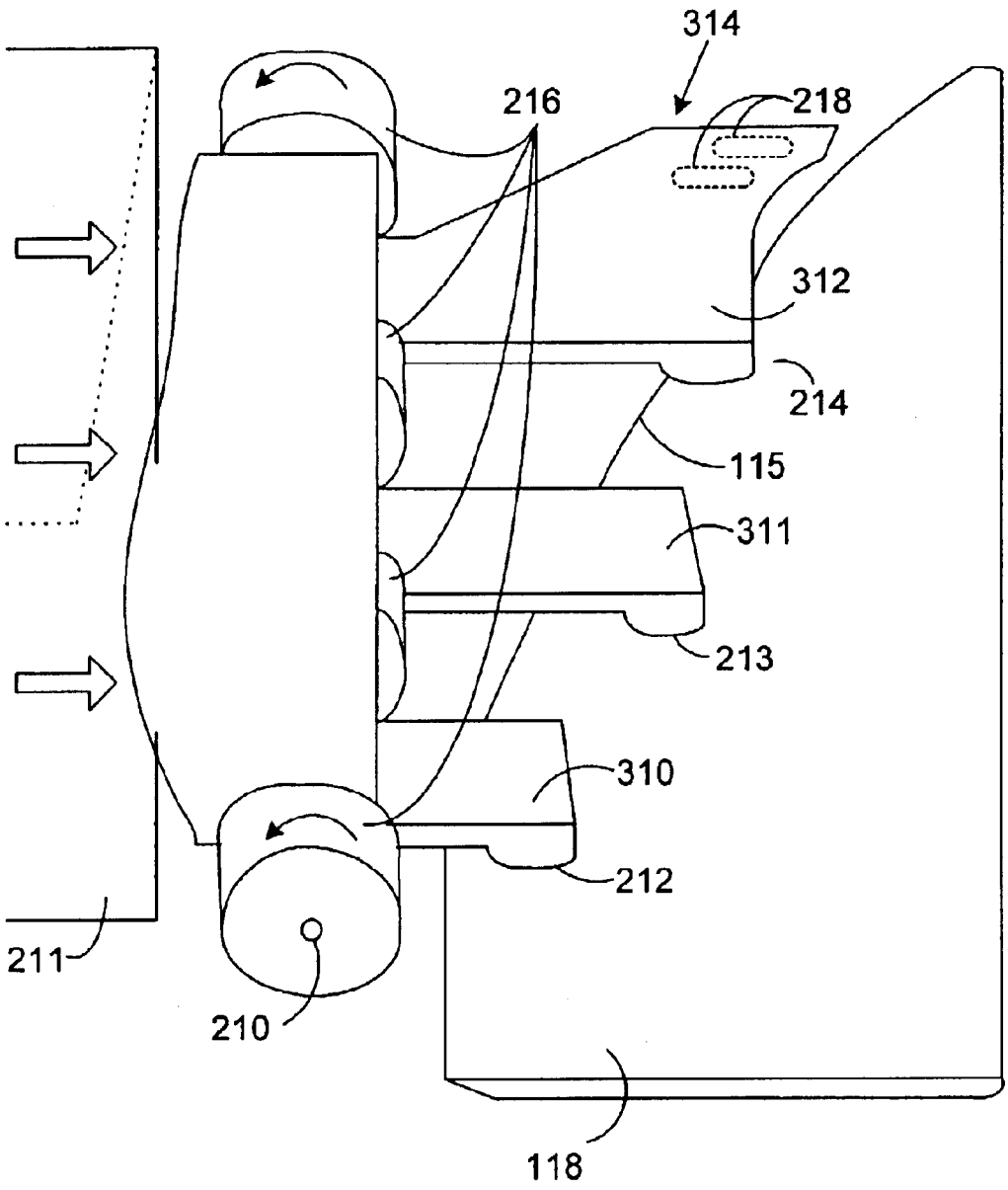
FIG. 3 illustrates a perspective of a multi-ski assembly according to the present invention in relation to a stripping blade of a mailing machine.

Referring now to FIGS. 2 and 3, a multi-ski assembly 201 according to the present invention is illustrated. The multi-ski assembly 201 can be pivotally or fixedly attached to the mailing machine via a rod (not shown) and mounting holes 202. A plurality of skis, such as, for example, skis 310, 311 and 312, can be attached to a shaft, such as, for example, idler shaft 210. Embodiments can include each ski 310, 311, 312 moving independently and being capable of pivoting up and down on the idler shaft 210. Alternatively, the plurality of skis 310, 311, 312 can be attached to each other to move as a single unit.

A respective spring 217 can provide a normal force holding each ski 310–312 down onto the top of the stripping blade 118. The ski normal force can be set to accommodate variables of the mail piece transport, such as, for example, speed of the transport, envelope size, envelope thickness, envelope weight, or other variables. Embodiments can include, for example, a normal force of 0.3 to 0.5 pounds applied to the multi-ski guide 201.

The multi-ski guide 201 can contact the stripping blade 118 with one or more contact bumps 212–214. In addition, one or more inner skis, such as, for example, ski 312, can include one or more mail piece guide bumps 218 which are positioned to guide a mail piece prior to the mail piece reaching the stripper blade 118. Preferably, the guide bumps 218 do not contact the stripper blade 118.

The mail piece guide bumps 218 can contact a mail piece prior to the flap of the mail piece 211 contacting the stripper blade 118 and facilitate the mail piece being properly aligned with the stripper blade 118 by preventing the flap of the mail piece from rising up above the stripper blade 118. Embodiments can include rollers 216, such as, for example, idler segments, interspersed between the skis included in the multi-ski guide 201. The idler segments 216 can guide and flatten a mail piece approaching the stripper blade 118. Alternatively, if multi-ski assembly 201 is fixedly attached, rollers 216 could be drive rollers having opposing movable idler segments in the transport deck 123.

As shown in FIG. 3, each ski 310–312 can be positioned to contact the stripper blade 118 with a contact bump 212–214. Each contact bump 212–214 can be formed into the underside of a respective ski 310–312. Embodiments can include an inner ski 312 with an extended portion 314 of the ski 312 allowing the inner ski 312 to provide additional guide bumps 218 over an area of a mail piece 211 that moves under an innermost idler segment 216. The extended portion of the ski can be utilized to support one more mail piece guiding bumps 218. The cut away shows how a mail piece 211 can traverse a transport deck 123 and come into contact with idler segments 216. The idler segments 216 can facilitate the mail piece 211 traversing the transport deck under the skis 310–312 and into contact with the stripper blade 118.

Embodiments can include a different normal force applied to an inner ski 312 as compared to an outer ski 310–311. For example, an inner ski 312 can have a greater normal force applied to it than an outer ski 310. Therefore, if an outer ski 310 has a normal force of 0.4 lbs. applied to it, an inner ski 312 may have a normal force of 0.5 lbs. or more. The normal force can be adjusted with tension applied from a corresponding spring 217. Accordingly, embodiments can include a different normal force applied to each ski.

In another aspect, some embodiments can include an inner ski 312 that does not engage a stripper blade 118 tip. Outer skis 310, 311 will engage the blade 118 with the bumps 212–213 resting on the blade 118, as shown in FIG. 3. FIG. 3 also illustrates an embodiment with the inner ski 312 engaging the blade with a bump 214. However, some embodiments can terminate the inner ski 312 can prior to contacting the stripper blade 118.

Figure 4:
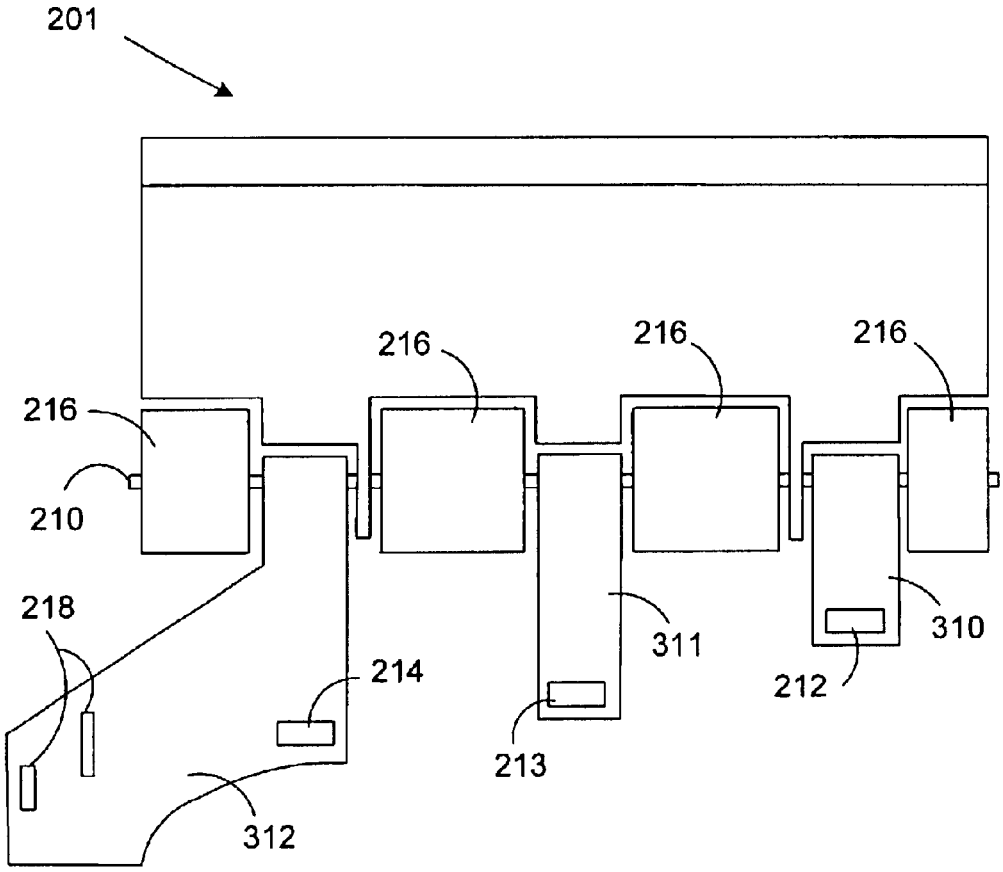
FIG. 4 illustrates an underside view of one embodiment of a multi-ski assembly including an inner ski with multiple contact bumps.

Referring now to FIG. 4, an exemplary multi-ski guide 201 viewed from the underside is illustrated. The multi-ski guide 201 can include two or more skis 310–312. Placement of each ski 310–312 can be situated to optimally guide a mail piece traversing the transport deck 123. For example, placement of skis 310–312 can follow the slope of a curve on a stripper blade 118. The skis 310–312 can be staggered in length, such that the staggered lengths of the skis 310–312 generally follow the slope of a curve of a leading edge 115 of a stripper blade 118 (FIG. 3).

Design of an innermost ski 312 can force a flap edge of an envelope to bend down toward the stripper blade 118 tip and facilitate opening the flap for stripping. Each ski 310–312 can include one or more blade contact bumps 212–214 that come into contact with the stripper blade 118. In addition, one or more inner skis 312, such as for example an inner most ski 312 which is aligned with a side of an envelope 211 which includes the envelope flap, can also include one or more mail piece guiding contact bumps 218.

Embodiments can include outer skis 310–311 which are designed, for example, with blade contact bumps 212–214 that rest on top of the stripper blade 118 approximately 2 mm to 3 mm from the leading edge 115 of the stripper blade 118, such as, for example, at approximately 2.5 mm. An inner ski 312 can include one or more mail piece guiding bumps 218 as well as a blade contact bump 214. The mail piece contact bumps 218 can engage a mail piece 211 prior to the leading edge of the flap of mail piece 211 encountering the tip of the stripping blade 118. The surface of the skis 310–312 can form a floating paper guide set that forces envelopes or other mail pieces to engage the stripper blade 118 top after the envelope edge has passed the stripper blade 118 edge and before the flap edge reaches the stripper blade 118 edge.

The mail piece path plane can be set to the stripper blade 118 top such that skis 310–312 interacting with the stripper blade 118 form a floating paper guide set which facilitates stripping a wider latitude of mail piece flap types and styles. Similarly, since the idlers 216 can carry the pivot point upward as the thickness of a mail piece 211 increases, mail pieces 211 of various thickness can be handled in a similar way.

Placing idler segments 216 on an idler shaft between the skis 310–312 can also act in conjunction with the downward pressure of the skis 310–312 provided by the normal force of the springs 217 to have a flattening effect on a mail piece 211 that may have been corrugated by the corrugating separator prior to engaging the stripping blade. The idler segments can extend the full width of the stripper blade 118 to facilitate a straight mail piece 211 edge approaching the stripping blade 118. Upon reaching the stripping blade 118 the mail piece 211 is optimally positioned for stripping.

A multiple ski design can minimize cross blade jams since an envelop edge is already situated on top of the stripper blade 118 as a result of its interaction with two outer skis 310–311 and the stripper blade 118. Designs utilizing various number of skis can have a similar effect facilitated by skis in the relative outer positions.

A set of skis 310–312 can act to guide a lower surface of an envelope into contact with the stripper blade 118 and make the envelope flap available for stripping. Typically, a three ski design can have a more significant effect on a thinner mail piece, such as a mail piece of ⅛" or less, due to the relative flexibility of the thinner mail.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. For example, bumps and guiding features can be placed at various locations according to variations in transport mechanisms. In addition, a number of skis utilized and relative placements of each ski can be modified to accommodate particular applications, such as, different shapes for stripper blades or deck width. Other variations relating to implementation of the functions described herein can also be implemented. Accordingly, other embodiments are within the scope of the following claims.

What is claimed is:

1. A device for processing a mail piece comprising:

a transport deck;

means for feeding the mail piece in a path along the transport deck;

a stripper blade associated with the transport deck for operational engagement with the mail piece the transport deck, the stripper blade including a blade edge having an angle profile with respect to said path for engaging the mail piece to separate a flap from the mail piece;

a ski guide comprising a plurality skis associated with the stripper blade to guide the mail piece into operational engagement with the stripper blade, each ski of the ski guide having a different length that correlates generally with said profile of the blade edge of the stripper blade; and at least one spring to provide a normal force to hold the ski guide against the stripper blade.

2. The device according to claim 1, wherein each ski of the ski guide moves independently of other skis and the at least one spring further comprises a respective spring to hold each ski of the ski guide against the stripper blade.

3. The device according to claim 2 wherein the normal force provided by each respective spring comprises a force in the range of 0.3 pounds to 0.6 pounds of pressure on the respective ski of the ski guide.

4. The device according to claim 1 wherein the blade edge profile includes a portion of an arc.

5. The device according to claim 1 wherein the ski guide comprises 3 skis.

6. The device according to claim 1 wherein each ski of the ski guide further comprises at least one contact bump formed on a lower side of the ski for contacting the stripper blade.

7. The device according to claim 6 wherein an inner most ski of the ski guide further comprises at least one mail piece guiding bump formed on a lower side and positioned to contact the mailpiece traversing the transport deck prior to the mailpiece engaging the stripper blade.

8. The device according to claim 6 wherein the contact bumps rest on top of the stripper blade within approximately 2 mm to 3 mm from a leading edge of the stripper blade.

9. The device according to claim 6 wherein the contact bumps rest on top of the stripper blade 3 mm or more from a leading edge of the stripper blade.

10. The device according to claim 1 wherein the ski guide further comprises:

at least one roller segment for guiding the mail piece into engagement with the stripper blade.

11. The device according to claim 10 wherein the ski guide further comprises:

a plurality of roller segments wherein at least a portion of the plurality of roller segments are interspersed between skis comprising the ski guide.

12. The device according to claim 10 wherein the at least one roller segment is an idler roller.

13. The device according to claim 10 wherein the at least one roller segment is a drive roller.

14. The device according to claim 1 wherein the ski guide is pivotally attached.

15. The device according to claim 1 wherein an inner ski of the ski guide further comprises an extended portion including at least one mail piece guiding bump.

16. The device according to claim 15 wherein the extended portion extends inward and forward towards the stripping blade.

17. The device according to claim 1 wherein the ski guide comprises skis of staggered lengths generally conforming to the shape of an arc.

18. The device according to claim 1 wherein the normal force provided by that at least one spring comprises a force in the range of 0.3 pounds to 0.6 pounds of pressure on the ski guide.

19. A method for guiding a mailpiece along a path of a transport deck on a mail machine to operational engagement with a stripper blade, the method comprising:

feeding a mail piece across the transport deck and into engagement with the stripper blade to separate a flap from a body of the mail piece, the stripper blade including a blade edge having an angle profile with respect to said path for engaging the mail piece;

guiding the mail piece with a ski guide associated with the stripper blade, the ski guide comprising a plurality of skis, each ski of the ski guide having a different length that correlates generally with said blade edge profile of the stripper blade; and applying a normal force to hold each ski of the ski guide against the stripper blade.

20. The method of claim 19 further comprising:

contacting the stripper blade with at least one contact bump formed into each ski of the ski guide.

21. The method of claim 20 wherein each contact bump rests on top of the stripper blade within approximately 2 mm to 3 mm from the blade edge of the stripper blade.

22. The method of claim 19 wherein the ski guide includes idler segments between each ski.

23. The method of claim 19 wherein the ski guide is attached to a shaft located prior to the stripper blade.

24. The method of claim 19 further comprising:

contacting the mail piece with at least one mail piece guiding bump formed into an innermost ski of the ski guide.

* * * * *

UNITED STATES PATENT AND TRADEMARK OFFICE

CERTIFICATE OF CORRECTION

PATENT NO. : 6,766,626 B2
APPLICATION NO. : 10/271124
DATED : July 27, 2004
INVENTOR(S) : Robert P. Rebres et al.

It is certified that error appears in the above-identified patent and that said Letters Patent is hereby corrected as shown below:

Column 6, line 36, after “engagement with mail piece” insert --traversing--.

Column 6, line 38, delete “angle”, replace with --angled--.

Column 8, line 7, delete “angle”, replace with --angled--.

Signed and Sealed this

Fifth Day of September, 2006

JON W. DUDAS
*Director of the United States Patent and Trademark Office*